US011547912B2

(12) United States Patent
Davis et al.

(10) Patent No.: US 11,547,912 B2
(45) Date of Patent: Jan. 10, 2023

(54) SPORTING GOODS INCLUDING MICROLATTICE STRUCTURES

(71) Applicant: Bauer Hockey Ltd., Blainville (CA)

(72) Inventors: Stephen J. Davis, Van Nuys, CA (US); Dewey Chauvin, Simi Valley (CA)

(73) Assignee: Bauer Hockey Ltd., Blainville, CA (US)

( * ) Notice: Subject to any disclaimer, the term of this patent is extended or adjusted under 35 U.S.C. 154(b) by 0 days.

(21) Appl. No.: 16/440,717

(22) Filed: Jun. 13, 2019

(65) Prior Publication Data

US 2019/0290983 A1 Sep. 26, 2019

Related U.S. Application Data

(63) Continuation of application No. 15/922,526, filed on Mar. 15, 2018, which is a continuation of application (Continued)

(51) Int. Cl.
*A63B 59/51* (2015.01)
*A43B 1/00* (2006.01)

(Continued)

(52) U.S. Cl.
CPC ..... *A63B 59/51* (2015.10); *A43B 1/00* (2013.01); *A63B 59/54* (2015.10); *A63B 59/70* (2015.10);

(Continued)

(58) Field of Classification Search
CPC ..... A63B 59/51; A63B 59/54; A63B 59/70; A63B 60/08; A63B 60/54; A63B 71/10;

(Continued)

(56) References Cited

U.S. PATENT DOCUMENTS 4,124,208 A * 11/1978 Burns ..... A63B 59/70 473/562
5,217,221 A 6/1993 Baum (Continued)

FOREIGN PATENT DOCUMENTS

CA 2294301 A1 1/2000
CA 2949062 A1 11/2015

(Continued)

OTHER PUBLICATIONS

Jacobsen et al., Interconnected self-propagating photopolymer waveguides: An alternative to stereolitography for rapid formation of lattice-based open-cellelar materials:, Twenty-First AnnualInternational Solid Freeform Fabrication Symposium, Austin, TX Aug. 9, 2010, 846-853.

(Continued)

*Primary Examiner* — Jeffrey S Vanderveen
(74) *Attorney, Agent, or Firm* — Banner & Witcoff, Ltd.

(57) ABSTRACT

A sporting good implement, such as a hockey stick or ball bat, includes a main body. The main body may be formed from multiple layers of a structural material, such as a fiber-reinforced composite material. One or more microlattice structures may be positioned between layers of the structural material. One or more microlattice structures may additionally or alternatively be used to form the core of a sporting good implement, such as a hockey-stick blade. The microlattice structures improve the performance, strength, or feel of the sporting good implement.

36 Claims, 3 Drawing Sheets

Related U.S. Application Data

No. 14/276,739, filed on May 13, 2014, now Pat. No. 9,925,440.

(51) Int. Cl.

| | |
|---|---|
| ***A63B 71/10*** | (2006.01) |
| ***A63B 59/54*** | (2015.01) |
| ***A63B 59/70*** | (2015.01) |
| ***A63B 60/08*** | (2015.01) |
| ***A63B 60/54*** | (2015.01) |
| ***A43B 5/16*** | (2006.01) |
| ***A42B 3/00*** | (2006.01) |
| ***A63B 102/24*** | (2015.01) |
| ***A63B 102/18*** | (2015.01) |
| ***A63B 102/22*** | (2015.01) |

(52) U.S. Cl.

CPC ..... *A63B 60/08* (2015.10); *A63B 60/54* (2015.10); *A63B 71/10* (2013.01); *A42B 3/00* (2013.01); *A43B 5/16* (2013.01); *A63B 2102/18* (2015.10); *A63B 2102/22* (2015.10); *A63B 2102/24* (2015.10); *A63B 2209/00* (2013.01); *A63B 2209/02* (2013.01)

(58) Field of Classification Search

CPC ..... A63B 2102/22; A63B 2209/00; A63B 2209/02; A63B 2102/24; A63B 2102/18; A43B 1/00; A43B 5/16; A42B 3/00

See application file for complete search history.

(56) References Cited

U.S. PATENT DOCUMENTS

| | | | | |
|---|---|---|---|---|
| 5,593,158 | A | 1/1997 | Filice et al. | |
| 5,661,854 | A | 9/1997 | March, II | |
| 5,865,696 | A | 2/1999 | Calapp et al. | |
| 6,015,156 | A | 1/2000 | Pratt | |
| 6,033,328 | A | 3/2000 | Bellefleur et al. | |
| 6,805,642 | B2 * | 10/2004 | Meyer | A63B 60/54 473/320 |
| 6,918,847 | B2 * | 7/2005 | Gans | A63B 59/70 473/563 |
| 7,008,338 | B2 | 3/2006 | Pearson | |
| 7,382,959 | B1 | 6/2008 | Jacobsen | |
| 7,424,967 | B2 | 9/2008 | Ervin et al. | |
| 7,510,206 | B2 * | 3/2009 | Walker | A63C 5/025 280/600 |
| 7,627,938 | B2 | 12/2009 | Kim et al. | |
| 7,824,591 | B2 | 11/2010 | Gans | |
| 7,963,868 | B2 | 6/2011 | McGrath et al. | |
| 8,921,702 | B1 | 12/2014 | Carter et al. | |
| 9,086,229 | B1 | 7/2015 | Roper et al. | |
| 9,116,428 | B1 | 8/2015 | Jacobsen et al. | |
| 9,119,433 | B2 | 9/2015 | Leon | |
| 9,486,679 | B2 | 11/2016 | Goldstein et al. | |
| 9,566,758 | B2 * | 2/2017 | Cheung | E04C 3/02 |
| 9,839,251 | B2 | 12/2017 | Pannikottu et al. | |
| 9,841,075 | B2 | 12/2017 | Russo | |
| 9,892,214 | B2 | 2/2018 | Morrow et al. | |
| 9,925,440 | B2 | 3/2018 | Davis et al. | |
| 10,525,315 | B1 * | 1/2020 | Wells | A63B 1/00 |
| 10,875,239 | B2 | 12/2020 | McCluskey | |
| 2005/0245090 | A1 | 11/2005 | Mori et al. | |
| 2007/0270253 | A1 | 11/2007 | Davis et al. | |
| 2007/0277296 | A1 | 12/2007 | Bullock | |
| 2009/0264230 | A1 | 10/2009 | Thouin | |
| 2010/0156058 | A1 * | 6/2010 | Koyess | A43B 5/16 12/142 P |
| 2010/0160095 | A1 | 6/2010 | Chauvin et al. | |
| 2011/0111954 | A1 | 5/2011 | Li et al. | |
| 2012/0297526 | A1 | 11/2012 | Leon | |
| 2013/0025031 | A1 | 1/2013 | Laperriere et al. | |
| 2013/0025032 | A1 | 1/2013 | Durocher et al. | |
| 2013/0143060 | A1 | 6/2013 | Jacobsen et al. | |
| 2013/0196175 | A1 | 8/2013 | Levit et al. | |
| 2014/0013492 | A1 | 1/2014 | Bottlang et al. | |
| 2014/0272275 | A1 | 9/2014 | Yang et al. | |
| 2014/0311315 | A1 | 10/2014 | Isaac | |
| 2015/0298443 | A1 | 10/2015 | Hundley et al. | |
| 2015/0307044 | A1 * | 10/2015 | Hundley | B29C 39/38 293/120 |
| 2015/0328512 | A1 | 11/2015 | Davis et al. | |
| 2016/0192741 | A1 | 7/2016 | Mark | |
| 2016/0327113 | A1 | 11/2016 | Shelley | |
| 2017/0273386 | A1 | 9/2017 | Kuo et al. | |
| 2017/0303622 | A1 | 10/2017 | Stone et al. | |
| 2018/0027914 | A1 | 2/2018 | Cook | |
| 2018/0027916 | A1 | 2/2018 | Smallwood | |
| 2018/0132556 | A1 | 5/2018 | Laperriere et al. | |
| 2018/0200591 | A1 | 7/2018 | Davis et al. | |
| 2018/0231347 | A1 | 8/2018 | Tyler et al. | |
| 2018/0345575 | A1 | 12/2018 | Constantinou et al. | |
| 2019/0290981 | A1 | 9/2019 | Davis et al. | |
| 2019/0290982 | A1 | 9/2019 | Davis et al. | |
| 2019/0290983 | A1 | 9/2019 | Davis et al. | |
| 2020/0022444 | A1 | 1/2020 | Stone et al. | |
| 2022/0079280 | A1 | 3/2022 | Laperriere et al. | |
| 2022/0142284 | A1 | 5/2022 | Laperriere et al. | |

FOREIGN PATENT DOCUMENTS

| | | | | |
|---|---|---|---|---|
| CA | 3054525 | | 11/2015 | |
| CA | 3054547 | C | 11/2015 | |
| CA | 2949062 | | 2/2020 | |
| CA | 3054525 | C | 2/2022 | |
| CA | 3054536 | C | 3/2022 | |
| CN | 105218939 | | 1/2016 | |
| EP | 3142753 | | 8/2019 | |
| WO | 2013025800 | A2 | 2/2013 | |
| WO | 2014100462 | | 6/2014 | |
| WO | WO-2014100462 | A1 * | 6/2014 | A43B 13/04 |
| WO | 2015175541 | A1 | 11/2015 | |
| WO | 2016209872 | | 12/2016 | |
| WO | 2017062945 | | 4/2017 | |
| WO | 2017136890 | | 8/2017 | |
| WO | 2017136941 | | 8/2017 | |
| WO | 2018072017 | A1 | 4/2018 | |
| WO | 2018072034 | A1 | 4/2018 | |
| WO | 2018157148 | | 8/2018 | |
| WO | 2020028232 | | 2/2020 | |
| WO | 2020232550 | | 11/2020 | |
| WO | 2020232552 | | 11/2020 | |
| WO | 2020232555 | | 11/2020 | |
| WO | 2021062519 | | 4/2021 | |

OTHER PUBLICATIONS

Jul. 31, 2015—(PCT)—International Search Report and Written Opinion—App PCT/US15/30383.

Jan. 22, 2018—(EP)—European Search Report—App. No. 15793488.6.

Sep. 20, 2017—(CA) Examiner's Report—App. No. 2,949,062—MM.

Advisory Action dated Jun. 14, 2016 in connection with U.S. Appl. No. 14/276,739, 3 pages.

Advisory Action dated Mar. 21, 2017 in connection with U.S. Appl. No. 14/276,739, 3 pages.

Applicant-Initiated Interview Summary dated Aug. 15, 2017 in connection with U.S. Appl. No. 14/276,739, 3 pages.

Applicant-Initiated Interview Summary dated Jun. 13, 2016 in connection with U.S. Appl. No. 14/276,739, 2 pages.

Notice of Allowance dated Feb. 14, 2018 in connection with U.S. Appl. No. 14/276,739, 2 pages.

Notice of Allowance dated Nov. 16, 2017 in connection with U.S. Appl. No. 14/276,739, 3 pages.

Notice of Allowance dated Nov. 9, 2017 in connection with U.S. Appl. No. 14/276,739, 7 pages.

Office Action dated Aug. 24, 2015 in connection with U.S. Appl. No. 14/276,739, 5 pages.

(56) References Cited

OTHER PUBLICATIONS

Office Action dated Dec. 9, 2016 in connection with U.S. Appl. No. 14/276,739, 5 pages.
Office Action dated Jul. 20, 2016 in connection with U.S. Appl. No. 14/276,739, 5 pages.
Office Action dated Mar. 7, 2016 in connection with U.S. Appl. No. 14/276,739, 6 pages.
Office Action dated May 1, 2017 in connection with U.S. Appl. No. 14/276,739, 7 pages.
Restriction Requirement dated Jun. 9, 2015 in connection with U.S. Appl. No. 14/276,739, 5 pages.
Advisory Action dated Mar. 17, 2021 in connection with U.S. Appl. No. 15/922,526, 3 pages.
Examiner Report dated Nov. 25, 2020 in connection with Canadian Patent Application No. 3054547, 5 pages.
Examiner Report dated Nov. 25, 2020 in connection with Canadian Patent Application No. 3054536, 5 pages.
Examiner Report dated Nov. 24, 2020, in connection with Canadian Patent Application No. 3,054,525, 5 pages.
Examiner Report dated Nov. 25, 2020 in connection with Canadian Patent Application No. 3054530, 7 pages.
Examiner's Report dated Jul. 29, 2019 in connection with Canadian Patent Application 2,949,062, 3 pages.
Final Office Action dated Nov. 23, 2020 in connection with U.S. Appl. No. 15/922,526, 17 pages.
Final Office Action dated Feb. 9, 2021 in connection with U.S. Appl. No. 16/440,655, 39 pages.
Final Office Action dated Feb. 9, 2021 in connection with U.S. Appl. No. 16/440,691, 41 pages.
International Search Report and Written Opinion dated Aug. 19, 2020 in connection with International Patent Application PCT/CA2020/050689, 11 pages.
International Search Report dated Aug. 20, 2020 in connection with International PCT application No. PCT/CA2020/050683, 5 pages.
International Search Report dated Aug. 21, 2020 in connection with International PCT application No. PCT/CA2020/050686, 4 pages.
International Search Report dated Aug. 25, 2020 in connection with International PCT application No. PCT/CA2020/050684, 6 pages.
Non-Final Office Action dated Jun. 19, 2019 in connection with U.S. Appl. No. 15/922,526, 15 pages.
Non-Final Office Action dated Jun. 5, 2020 in connection with U.S. Appl. No. 15/922,526, 16 pages.
Non-Final Office Action dated Oct. 15, 2020 in connection with U.S. Appl. No. 16/440,691, 33 pages.
Non-Final Office Action dated Oct. 15, 2020 in connection with U.S. Appl. No. 16/440,655, 41 pages.
Restriction Requirement dated Jul. 20, 2020 in connection with U.S. Appl. No. 16/440,691, 6 pages.
Restriction Requirement dated Mar. 5, 2019 in connection with U.S. Appl. No. 15/922,526, 6 pages.
Written Opinion dated Aug. 20, 2020 in connection with International PCT application No. PCT/CA2020/050683, 8 pages.
Written Opinion dated Aug. 21, 2020 in connection with International PCT application No. PCT/CA2020/050686, 5 pages.
Written Opinion dated Aug. 25, 2020 in connection with International PCT application No. PCT/CA2020/050684, 7 pages.
Wang, X. et al., 3D printing of polymer matrix composites: A review and prospective, Composites Part B, 2017, vol. 110, pp. 442-458.
Wirth, D. M. et al. Highly expandable foam for litographic 3D printing, ACS Appl. Mater. Interfaces, 2020, 12 pp. 19033-19043.
Restriction Requirement dated Jul. 17, 2020 in connection with U.S. Appl. No. 16/440,655, 9 pages.
Examiner Report dated Apr. 27, 2021 in connection with Canadian Patent Application No. 3,054,525, 3 pages.
Examiner Report dated Apr. 27, 2021 in connection with Canadian Patent Application No. 3,054,530, 4 pages.
Examiner Report dated Apr. 27, 2021 in connection with Canadian Patent Application No. 3,054,536, 5 pages.
Examiner Report dated Apr. 27, 2021 in connection with Canadian Patent Application No. 3,054,547, 5 pages.
Examiner Report dated Aug. 2, 2021 in connection with Canadian Patent Application No. 3,054,530, 3 pages.
International Preliminary Report on Patentability dated Oct. 1, 2021 in connection with International Patent Application PCT/CA2020/050689, 31 pages.
International Preliminary Report on Patentability dated Sep. 14, 2021 in connection with International Patent Application PCT/CA2020/050683, 17 pages.
International Preliminary Report on Patentability dated Sep. 3, 2021 in connection with International Patent Application PCT/CA2020/050686, 54 pages.
Non-Final Office Action dated Sep. 7, 2021 in connection with U.S. Appl. No. 16/440,655, 35 pages.
Non-Final Office Action dated Sep. 7, 2021 in connection with U.S. Appl. No. 16/440,691, 33 pages.
Non-Final Office Action issued Sep. 7, 2021 in connection with U.S. Appl. No. 15/922,526, 22 pages.
Final Office Action dated Apr. 4, 2022 in connection with U.S. Appl. No. 15/922,526, 24 pages.
Final Office Action dated Apr. 4, 2022 in connection with U.S. Appl. No. 16/440,655, 39 pages.
Final Office Action dated Apr. 4, 2022 in connection with U.S. Appl. No. 16/440,717, 20 pages.
International Preliminary Report on Patentability dated Feb. 8, 2022 in connection with International Patent Application PCT/CA2020/050684, 11 pages.
Written Opinion dated Dec. 14, 2021 in connection with International PCT application No. PCT/CA2020/050684, 7 pages.
Non-Final Office Action dated Mar. 14, 2022 in connection with U.S. Appl. No. 17/611,262, 36 pages.
Final Office Action dated Apr. 4, 2022 in connection with U.S. Appl. No. 16/440,691, 31 pages.
Non-Final Office Action dated Sep. 9, 2022 in connection with U.S. Appl. No. 16/440,691, 32 pages.
Non-Final Office Action dated Sep. 9, 2022 in connection with U.S. Appl. No. 16/440,655, 39 pages.

* cited by examiner

SPORTING GOODS INCLUDING MICROLATTICE STRUCTURES

CROSS-REFERENCE TO RELATED APPLICATIONS

This application is a continuation of U.S. patent application Ser. No. 15/922,526, filed Mar. 15, 2018, which is a continuation of U.S. patent application Ser. No. 14/276,739, filed May 13, 2014, now U.S. Pat. No. 9,925,440. The contents of the aforementioned applications are incorporated herein by reference in their entirety.

BACKGROUND

Lightweight foam materials are commonly used in sporting good implements, such as hockey sticks and baseball bats, because their strength-to-weight ratios provide a solid combination of light weight and performance. Lightweight foams are often used, for example, as interior regions of sandwich structures to provide lightweight cores of sporting good implements.

Foamed materials, however, have limitations. For example, foamed materials have homogeneous, isotropic properties, such that they generally have the same characteristics in all directions. Further, not all foamed materials can be precisely controlled, and their properties are stochastic, or random, and not designed in any particular direction. And because of their porosity, foamed materials often compress or lose strength over time.

Some commonly used foams, such as polymer foams, are cellular materials that can be manufactured with a wide range of average-unit-cell sizes and structures. Typical foaming processes, however, result in a stochastic structure that is somewhat limited in mechanical performance and in the ability to handle multifunctional applications.

SUMMARY

A sporting good implement, such as a hockey stick or ball bat, includes a main body. The main body may be formed from multiple layers of a structural material, such as a fiber-reinforced composite material. One or more microlattice structures may be positioned between layers of the structural material. One or more microlattice structures may additionally or alternatively be used to form the core of a sporting good implement, such as a hockey-stick blade. The microlattice structures improve the performance, strength, or feel of the sporting good implement. Other features and advantages will appear hereinafter.

BRIEF DESCRIPTION OF THE DRAWINGS

In the drawings, wherein the same reference number indicates the same element throughout the views.

DETAILED DESCRIPTION OF THE DRAWINGS

Figure 1:
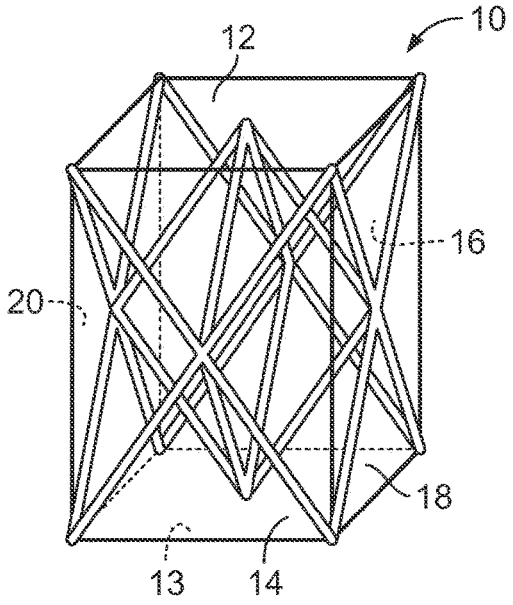
FIG. 1 is a perspective view of a microlattice unit cell, according to one embodiment.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Micro-scale lattice structures, or "microlattice" structures, include features ranging from tens to hundreds of microns. These structures are typically formed from a three dimensional, interconnected array of self-propagating photopolymer waveguides. A microlattice structure may be formed, for example, by directing collimated ultraviolet light beams through apertures to polymerize a photomonomer material. Intricate three-dimensional lattice structures may be created using this technique.

In one embodiment, microlattice structures may be formed by exposing a two-dimensional mask, which includes a pattern of circular apertures and covers a reservoir containing an appropriate photomonomer, to collimated ultraviolet light. Within the photomonomer, self-propagating photopolymer waveguides originate at each aperture in the direction of the ultraviolet collimated beam and polymerize together at points of intersection. By simultaneously forming an interconnected array of these fibers in three-dimensions and removing the uncured monomer, unique three-dimensional, lattice-based, open-cellular polymer materials can be rapidly fabricated.

The photopolymer waveguide process provides the ability to control the architectural features of the bulk cellular material by controlling the fiber angle, diameter, and three-dimensional spatial location during fabrication. The general unit-cell architecture may be controlled by the pattern of circular apertures on the mask or the orientation and angle of the collimated, incident ultraviolet light beams.

The angle of the lattice members with respect to the exposure-plane angle are controlled by the angle of the incident light beam. Small changes in this angle can have a significant effect on the resultant mechanical properties of the material. For example, the compressive modulus of a microlattice material may be altered greatly with small angular changes within the microlattice structure.

Microlattice structures can provide improved mechanical performance (higher stiffness and strength per unit mass, for example), as well as an accessible open volume for unique multifunctional capabilities. The photopolymer waveguide process may be used to control the architectural features of the bulk cellular material by controlling the fiber angle, diameter, and three-dimensional spatial location during fabrication. Thus, the microlattice structure may be designed to provide strength and stiffness in desired directions to optimize performance with minimal weight.

This manufacturing technique is able to produce three-dimensional, open-cellular polymer materials in seconds. In addition, the process provides control of specific microlattice parameters that ultimately affect the bulk material properties. Unlike stereolithography, which builds up three-dimensional structures layer by layer, this fabrication technique is rapid (minutes to form an entire part) and can use a single two-dimensional exposure surface to form three-dimensional structures (with a thickness greater than 25 mm possible). This combination of speed and planar scalability opens up the possibility for large-scale, mass manufacturing. The utility of these materials range from lightweight energy-absorbing structures, to thermal-management materials, to bio-scaffolds.

A microlattice structure may be constructed by this method using any polymer that can be cured with ultraviolet light. Alternatively, the microlattice structure may be made of a metal material. For example, the microlattice may be dipped in a catalyst solution before being transferred to a nickel-phosphorus solution. The nickel-phosphorus alloy may then be deposited catalytically on the surface of the polymer struts to a thickness of around 100 nm. Once coated, the polymer is etched away with sodium hydroxide, leaving a lattice geometry of hollow nickel-phosphorus tubes.

The resulting microlattice structure may be greater than 99.99 percent air, and around 10 percent less dense than the lightest known aerogels, with a density of approximately 0.9 $mg/cm^3$. Thus, these microlattice structures may have a density less than 1.0 $mg/cm^3$. A typical lightweight foam, such as Airex C71, by comparison, has a density of approximately 60 $mg/cm^3$ and is approximately 66 times heavier.

Further, the microengineered lattice structure has remarkably different properties than a bulk alloy. A bulk alloy, for example, is typically very brittle. When the microlattice structure is compressed, conversely, the hollow tubes do not snap but rather buckle like a drinking straw with a high degree of elasticity. The microlattice can be compressed to half its volume, for example, and still spring back to its original shape. And the open-cell structure of the microlattice allows for fluid flow within the microlattice, such that a foam or elastomeric material, for example, may fill the air space to provide additional vibration damping or strengthening of the microlattice material.

The manufacturing method described above could be modified to optimize the size and density of the microlattice structure locally to add strength or stiffness in desired regions. This can be done by varying:

- the size of the apertures in the mask to locally alter the size of the elements in the lattice;
- the density of the apertures in the mask to locally alter the strength or dynamic response of the system; or
- the angle of the incident collimated light to change the angle of the elements, which affects the strength and stiffness of the material.

The manufacturing method could also be modified to include fiber reinforcement. For example, fibers may be arranged to be co-linear or co-planar with the collimated ultraviolet light beams. The fibers are submersed in the photomonomer resin and wetted out. When the ultraviolet light polymerizes the photomonomer resin, the resin cures and adheres to the fiber. The resulting microlattice structure will be extremely strong, stiff, and light.

FIGS. 1-8 illustrate some examples of microlattice unit cells and microlattice structures. FIG. 1 shows a square unit cell 10 with a top plane 12 and a bottom plane 13 defining the cell shape. This is a single cell that would be adjacent to other similar cells in a microlattice structure. The cell 10 is defined by a front plane 14, an opposing rear plane 16, a right-side plane 18, and a left-side plane 20. It will be used as a reference in the building of a microlattice structure using four collimated beams controlled by a mask with circular apertures to create a lattice structure with struts of circular cross section.

Figure 2:
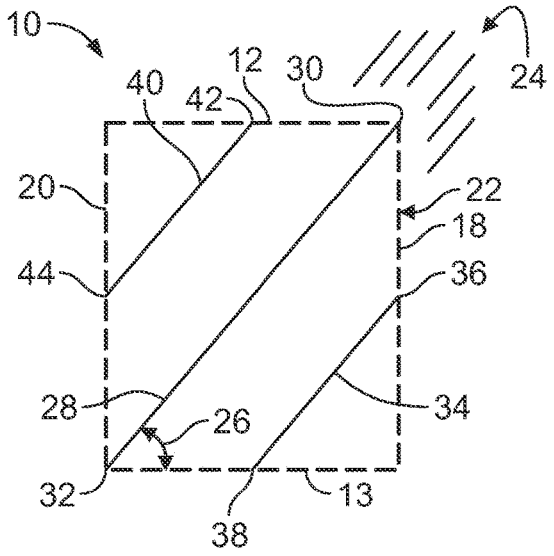
FIG. 2 is a side view of the unit cell of FIG. 1 with a collimated beam of light directed through an upper-right corner of the cell.

FIG. 2 shows a side view of the unit cell 10 with a dashed line 22 indicating the boundary of the cell 10. A collimated beam of light 24 is directed at an angle 26 controlled by a mask with apertures (not shown). A light beam 28 is oriented through an upper-right-corner node 30 and a lower-left-corner node 32. A parallel beam of light 34 is directed through a node 36 positioned on the center of right-side plane 18 and through a node 38 on the center of bottom plane 13. Similarly, a light beam 40 is directed through a node 42 positioned on the center of top plane 12 and through a node 44 positioned on the center of left-side plane 20. These light beams will polymerize the monopolymer material and fuse to other polymerized material.

Figure 3:
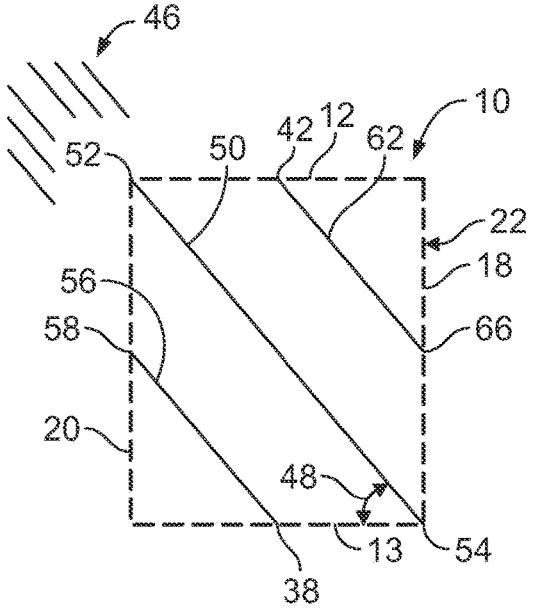
FIG. 3 is a side view of the unit cell of FIGS. 1 and 2 with a collimated beam of light directed through an upper-left corner of the cell.

FIG. 3 shows a side view of the unit cell 10 with a dashed line 22 indicating the boundary of the cell 10. A collimated beam of light 46 is directed at an angle 48 controlled by a mask with apertures (not shown). A light beam 50 is oriented through the upper-left-corner node 52 and lower-right-corner node 54. A parallel beam of light 56 is directed through a node 58 positioned on the center of left-side plane 20 and through a node 38 on the center of bottom plane 13. Similarly, a parallel light beam 62 is directed through a node 42 positioned on the center of top plane 12 and through a node 66 positioned on the center of right-side plane 18. These light beams will polymerize the monopolymer material and fuse to other polymerized material.

Figure 4:
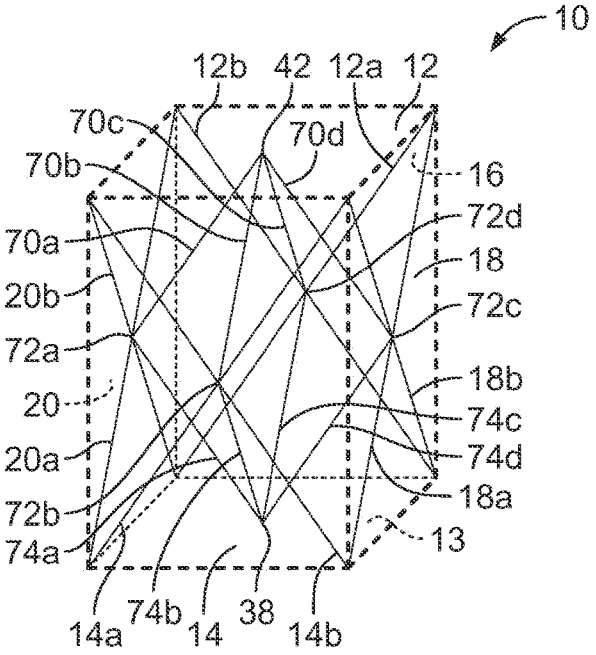
FIG. 4 is a perspective view of a microlattice unit cell resulting from repeating the processes illustrated in FIGS. 3 and 4, according to one embodiment.

This process is repeated for the other sets of vertical planes 12 and 14 resulting in the structure shown in FIG. 4. Long beams 14*a* and 14*b* on front plane 14 are parallel to respective beams 12*a* and 12*b* on rear plane 12. Long beams 18*a* and 18*b* on right plane 18 are parallel to respective beams 20*a* and 20*b* on left plane 20. Short beams 70*a*, 70*b*, 70*c*, and 70*d* connect at upper node 42 centered on top plane 12, and are directed to the center-face nodes 72*a*, 72*b*, 72*c*, and 72*d*. Similarly, short beams 74*a*, 74*b*, 74*c*, and 74*d* connect at lower node 38 centered on bottom plane 13 and connect to the short beams 70*a*, 70*b*, 70*c*, and 70*d* and center-face nodes 72*a*, 72*b*, 72*c*, and 72*d*.

Figure 5:
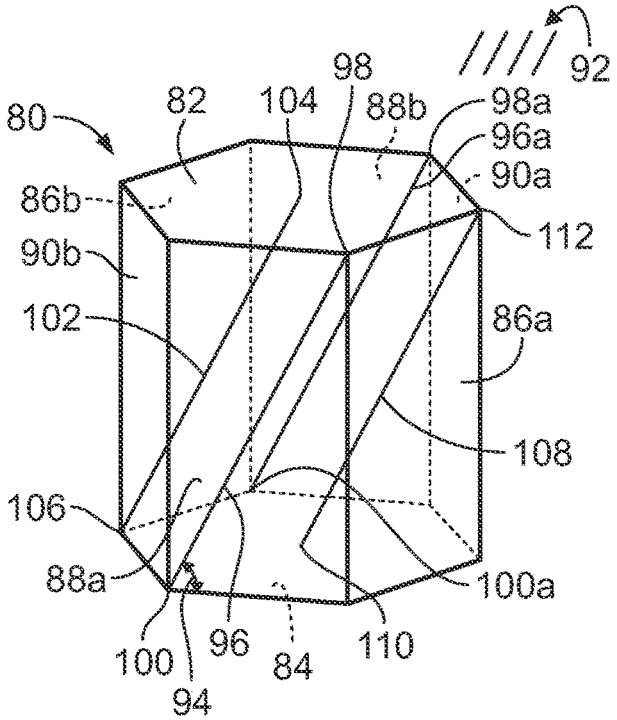
FIG. 5 is a perspective view of a hexagonal unit cell with a collimated beam of light directed through an upper-right region of the cell, according to one embodiment.

Alternatively, a hexagonal shaped cell can be constructed as shown in FIG. 5. A hexagonal unit cell 80 is defined by a hexagonal shaped top plane 82 and opposing bottom plane 84. Vertical plane 86*a* is opposed by vertical plane 86*b*. Vertical plane 88*a* is opposed by vertical plane 88*b*. Vertical plane 90*a* is opposed by vertical plane 90*b*. A collimated light beam 92 is directed at an angle 94 controlled by a mask with apertures (not shown). A beam 96 is formed through upper node 98 and lower node 100 on vertical plane 88*a*. Similarly, a beam 96*a* is formed through upper node 98*a* and lower node 100 on vertical plane 88*b*. A face-to-node beam 102 that is parallel to beams 96 and 96*a* is formed from the center 104 of top face 82 to the lower node 106. Another face-to-node beam 108 that is parallel to beams 96, 96*a*, and 102 is formed from the center 110 of bottom plane 84 to upper node 112.

Figure 6:
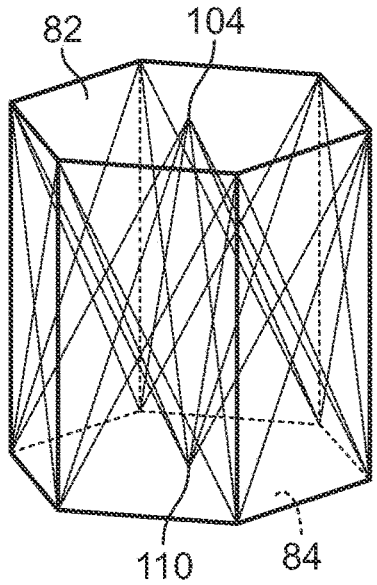
FIG. 6 is a perspective view of a hexagonal microlattice unit cell resulting from repeating the process illustrated in FIG. 5, according to one embodiment.

This process is repeated for the remaining two sets of vertically opposed planes to create the cell structure shown in FIG. 6. The resulting structure has two sets of node-to-node beams in each of the six vertical planes. It also has six face-to-node beams connected at the center node 104 of top plane 82, and six face-to-node beams connected at the center node 110 of bottom plane 84.

Cell structures 10 and 80 shown in FIGS. 4 and 6, respectively, are merely examples of structures that can be created. The cell geometry may vary according to the lattice structure desired. And the density of the microlattice structure may be varied by changing the angle of the beams.

Figure 7:
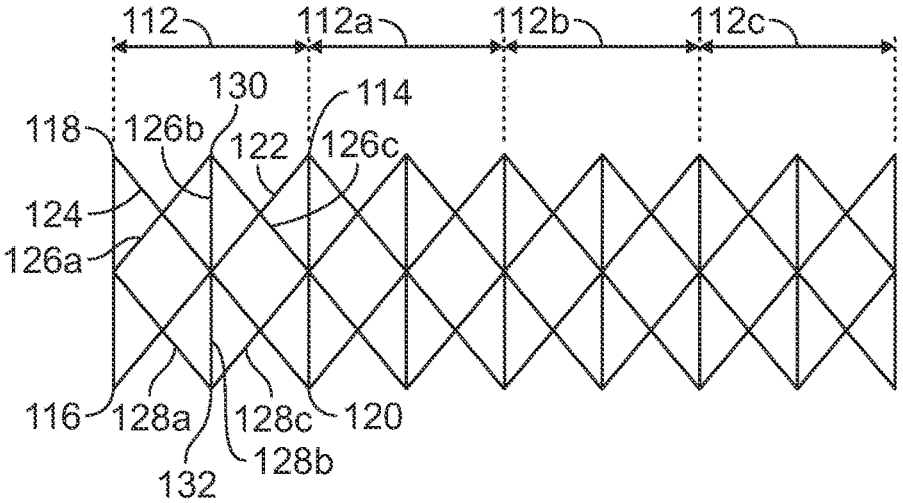
FIG. 7 is a side view of multiple microlattice unit cells of uniform density connected in a row, according to one embodiment.

FIG. 7 is a side view of multiple square cells, such as multiple unit cells 10, connected in a row. This simplified view shows the regular spacing between beams, and the equal cell dimensions. Dimension 112 denotes the width of a single cell unit. Dimension 112=112*a*=112*b*=112*c*, such that all cells are of uniform size and dimensions. The long beam 122 connects corner node 114 to corner node 116. Similarly, long beam 124 connects corner nodes 118 and 120. Short beams 126*a*, 126*b*, 126*c*, and a fourth short beam (not visible) connect to upper-center-face node 130. Similarly, short beams 128*a*, 128*b*, 128*c*, and a fourth short beam (not visible) connect to lower-center-face node 132.

Figure 8:
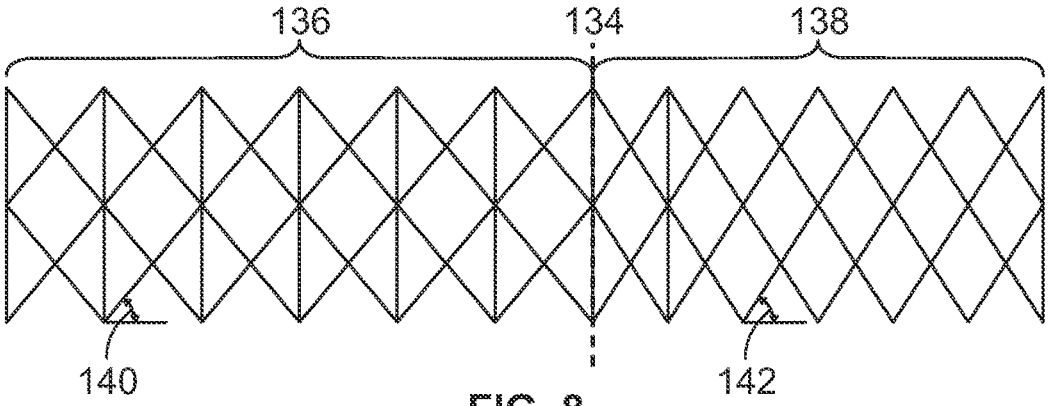
FIG. 8 is a side view of multiple microlattice unit cells of varying density connected in a row, according to one embodiment.

FIG. 8 represents an alternative design in which the density of the microlattice structure varies. To the left of line 134, the microlattice structure 136 has spacing as shown in FIG. 7. To the right of line 134, the microlattice structure 138 has spacing that is tighter and more condensed. In addition, the angle 142 of the beams is greater for structure 138 than the angle 140 for structure 136. Thus, structure 138 provides more compression resistance than structure 136.

Other design alternatives exist to vary the compression resistance of the microlattice structure. For example, the size of the lattice beams may vary by changing the aperture size in the mask. Thus, there are multiple ways to vary and optimize the local stiffness of the microlattice structure.

The microlattice structures described above may be used in a variety of sporting-good applications. For example, one or more microlattice structures may be used as the core of a hockey-stick blade. The stiffness and strength of the microlattice may be designed to optimize the performance of the hockey-stick blade. For example, the density of the microlattice may be higher in the heel area of the blade where pucks are frequently impacted when shooting slap-shots or trapping pucks—than in the toe region or mid-region of the blade. Further, the microlattice may be more open or flexible toward the toe of the blade to enable a faster wrist shot or to enhance feel and control of the blade.

One or more microlattice structures may also be used to enhance the laminate strength in a hockey-stick shaft, bat barrel, or bat handle. Positioning the microlattice as an interlaminar ply within a bat barrel, for example, could produce several benefits. The microlattice can separate the inner barrel layers from the outer barrel layers, yet allow the outer barrel to deflect until the microlattice reaches full compression, then return to a neutral position. The microlattice may be denser in the sweet-spot area where the bat produces the most power, and more open in lower-power regions to help enhance bat power away from the sweet spot.

For a hockey-stick shaft or bat handle, the microlattice may be an interlaminar material that acts like a sandwich structure, effectively increasing the wall thickness of the laminate, which increases the stiffness and strength of the shaft or handle.

One or more microlattice structures may also be used in or as a connection material between a handle and a barrel of a ball bat. Connecting joints of this nature have traditionally been made from elastomeric materials, as described, for example, in U.S. Pat. No. 5,593,158, which is incorporated herein by reference. Such materials facilitate relative movement between the bat barrel and handle, thereby absorbing the shock of impact and increasing vibration damping.

A microlattice structure used in or as a connection joint provides an elastic and resilient intermediary that can absorb compression loads and return to shape after impact. In addition, the microlattice can be designed with different densities to make specific zones of the connection joint stiffer than others to provide desired performance benefits. The microlattice structure also offers the ability to tune the degree of isolation of the barrel from the handle to increase the amount of control and damping without significantly increasing the weight of the bat.

Microlattice structures may also be used in helmet liners to provide shock absorption, in bike seats as padding, or in any number of other sporting-good applications. FIGS. 9-16 illustrate some specific examples.

Figure 9:
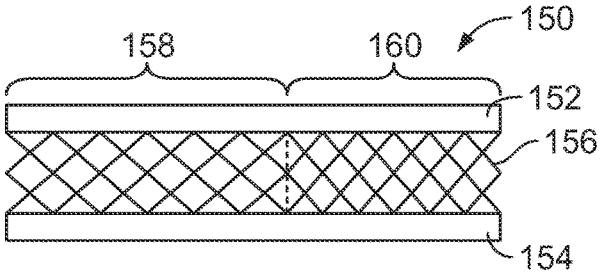
FIG. 9 is a side-sectional view of a hockey-stick blade including a microlattice core structure, according to one embodiment.

FIG. 9 shows a sandwich structure of a hockey-stick blade 150. The top laminate 152 and bottom laminate 154 of the blade 150 may be constructed of fiber-reinforced polymer resin, such as carbon-fiber-reinforced epoxy, or of another suitable material. A microlattice core 156 is positioned between the top and bottom laminates 152, 154. The microlattice core 156 may optionally vary in density such that it is lighter and more open in zone 158 (for example, at the toe-end of the blade), and denser and stronger in zone 160 (for example, at the heel-end of the blade).

Figure 10:
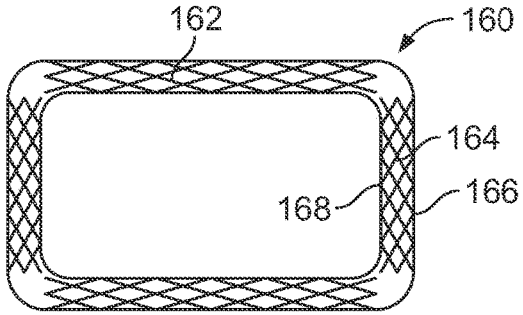
FIG. 10 is a top-sectional view of a hockey-stick shaft including a microlattice core structure between exterior and interior laminates of the shaft, according to one embodiment.

FIG. 10 shows a hockey-stick shaft 160 including a microlattice structure 162 acting as a core between an exterior laminate 166 and an interior laminate 168. Optionally, the microlattice 162 structure may have increased density in one or more shaft regions, such as in region 164 where more impact forces typically occur. Using the microlattice in this manner maintains sufficient wall thickness to resist compressive forces, yet reduces the overall weight of the hockey stick shaft relative to a traditional shaft.

Figure 11:
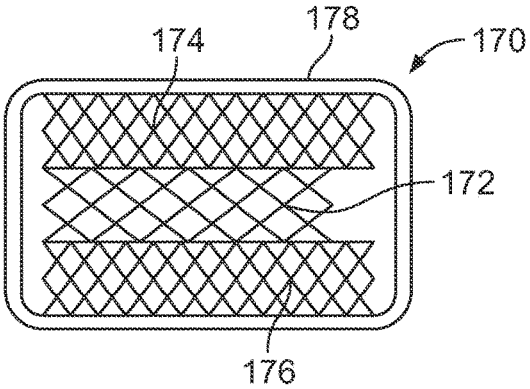
FIG. 11 is a top-sectional view of a hockey-stick shaft including a microlattice core structure in an interior cavity of the shaft, according to one embodiment.

FIG. 11 shows a hockey-stick shaft 170 with a microlattice structure 172 in an interior cavity of the shaft 170. In this embodiment, the microlattice structure is denser in regions 174 and 176 than in the central region 172. The microlattice structure is oriented in this manner to particularly resist compressive forces directed toward the larger dimension 178 of the shaft 170.

Figure 12:
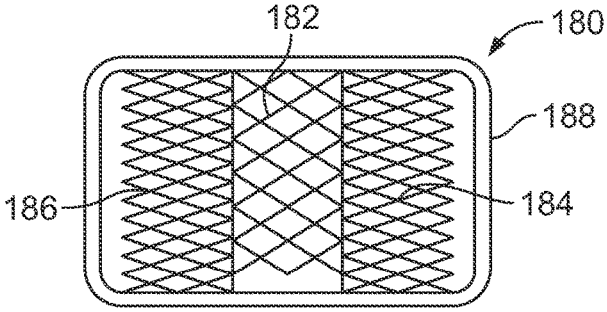
FIG. 12 is a top-sectional view of a hockey-stick shaft including a microlattice core structure in an interior cavity of the shaft, according to another embodiment.

FIG. 12 shows an alternative embodiment of a hockey-stick shaft 180 with a microlattice structure 182 in an interior cavity of the shaft. In this embodiment, the microlattice structure is more dense in regions 184 and 186 than in the central region 182. The microlattice structure is oriented in this manner to particularly resist compressive forces directed toward the smaller dimension 188 of the shaft 180.

Figure 13:
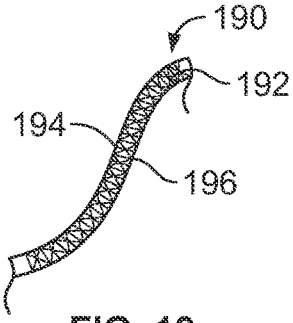
FIG. 13 is a side-sectional view of a portion of a hockey-skate boot including a microlattice core structure between exterior and interior layers of boot material.

FIG. 13 shows a cross section of a portion of a hockey skate boot 190. A microlattice structure 192 is sandwiched between the exterior material 194 and interior material 196 of the boot. The microlattice structure 192 may be formed as a net-shape contour, or formed between the exterior material 194 and the interior material 196. The exterior material 194 and interior material 196 may be textile-based, injection molded, a heat formable thermoplastic, or any other suitable material.

Figure 14:
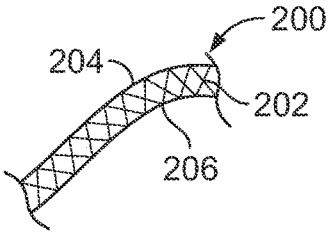
FIG. 14 is a side-sectional view of a portion of a sports helmet including a microlattice core structure between exterior and interior layers of the helmet.

FIG. 14 shows a cross section of a portion of a helmet shell 200. A microlattice structure 202 is sandwiched between the exterior material 204 and interior material 206 of the helmet. The microlattice structure 202 may be created as a net-shape contour, or formed between the exterior material 204 and the interior material 206. The exterior material 204 and interior material 206 may be textile-based, injection molded, a heat formable thermoplastic, or any other suitable material. The interior material 206 may optionally be a very light fabric, depending on the density and design of the microlattice structure 202. The microlattice structure 202 may optionally be a flexible polymer that is able to deform and recover, absorbing impact forces while offering good comfort.

Figure 15:
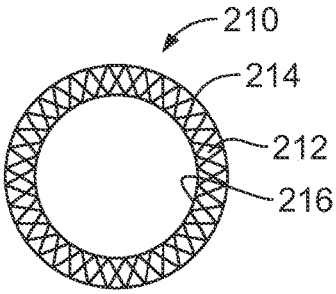
FIG. 15 is a top-sectional view of a bat barrel including a microlattice core structure between exterior and interior layers of the bat barrel.

FIG. 15 shows a cross-sectional view of a bat barrel 210 with a microlattice structure 212 sandwiched between an exterior barrel layer or barrel wall 214 and an interior barrel layer or barrel wall 216. The microlattice structure 212 may be formed as a straight panel that is rolled into the cylindrical shape of the barrel, or it may be formed as a cylinder. The microlattice structure 212 is able to limit the deformation of the exterior barrel wall 214 and to control the power of the bat while facilitating a light weight. The microlattice structure 212 may additionally or alternatively be used in the handle of the bat in a similar manner.

Figure 16:
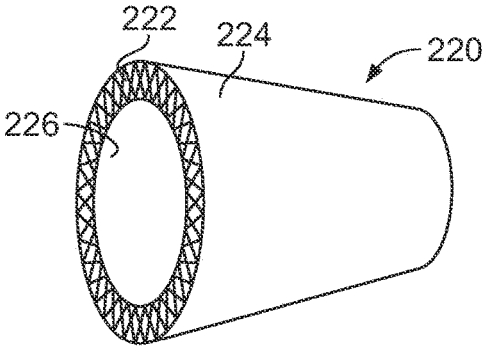
FIG. 16 is a perspective, partial-sectional view of a ball-bat joint including a microlattice core structure between exterior and interior layers of the joint.

FIG. 16 shows a conical joint 220 that may be used to connect a bat handle to a bat barrel. A microlattice structure 222 is sandwiched or otherwise positioned between an exterior material 224 and interior material 226 of the joint 220. The joint 220 may be bonded to the barrel and the handle of the bat or it may be co-molded in place. The barrel and handle may be a composite material, a metal, or any other suitable material or combination of materials. The microlattice structure 222 provides efficient movement of the barrel relative to the handle, and it further absorbs impact forces and dampens vibrations.

Any of the above-described embodiments may be used alone or in combination with one another. Further, the described items may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A skate comprising:

a first layer and a second layer opposite one another; and a lattice disposed between and covered by the first layer of the skate and the second layer of the skate;

wherein: the lattice comprises a predefined arrangement of structural members integral with one another and intersecting one another at nodes; respective ones of the nodes of the lattice are spaced apart from one another in three orthogonal directions that include a given direction of the skate from the first layer of the skate to the second layer of the skate; at least one of the first layer of the skate and the second layer of the skate comprises fiber-reinforced polymeric material; and at least one of the first layer of the skate and the second layer of the skate is heat-formable.

2. The skate of claim 1, comprising a skate boot that comprises the lattice.

3. The skate of claim 1, wherein a density of the lattice is variable.

4. The skate of claim 1, wherein a spacing of the structural members of the lattice is variable.

5. The skate of claim 1, wherein respective ones of the structural members of the lattice vary in size.

6. The skate of claim 1, wherein respective ones of the structural members of the lattice vary in orientation.

7. The skate of claim 1, wherein a resistance to compression of the lattice is variable.

8. The skate of claim 1, wherein a stiffness of the lattice is variable.

9. The skate of claim 1, wherein a first zone of the lattice is stiffer than a second zone of the lattice.

10. The skate of claim 9, wherein: a third zone of the lattice is stiffer than the second zone of the lattice; and the second zone of the lattice is disposed between the first zone of the lattice and the third zone of the lattice.

11. The skate of claim 1, wherein an openness of the lattice is variable.

12. The skate of claim 1, wherein a first zone of the lattice is more open than a second zone of the lattice.

13. The skate of claim 12, wherein: a third zone of the lattice is less open than the first zone of the lattice; and the first zone of the lattice is disposed between the second zone of the lattice and the third zone of the lattice.

14. The skate of claim 1, wherein the lattice occupies at least a majority of a cross-sectional dimension of the skate from the first layer of the skate to the second layer of the skate.

15. The skate of claim 1, wherein the fiber-reinforced polymeric material is carbon-fiber-reinforced polymeric material.

16. The skate of claim 1, wherein at least one of the first layer and the second layer comprises textile material.

17. The skate of claim 1, wherein: the first layer comprises the fiber-reinforced polymeric material; and a material of the second layer is different from the fiber-reinforced polymeric material.

18. The skate of claim 1, wherein the lattice is curved.

19. The skate of claim 1, wherein the lattice is polymeric.

20. The skate of claim 19, wherein the lattice is entirely polymeric.

21. The skate of claim 1, wherein the lattice is metallic.

22. The skate of claim 1, comprising filling material that fills at least part of hollow space of the lattice.

23. The skate of claim 22, wherein the filling material comprises foam.

24. The skate of claim 22, wherein the filling material comprises elastomeric material.

25. The skate of claim 22, wherein the filling material is configured to dampen vibrations.

26. The skate of claim 1, wherein the lattice is optically formed.

27. The skate of claim 26, wherein the lattice is optically formed by collimated light beams.

28. The skate of claim 26, wherein the lattice is optically formed by ultraviolet light.

29. The skate of claim 1, wherein the nodes of the lattice are disposed in at least four levels that are spaced apart from one another in the given direction from the first layer of the skate to the second layer of the skate.

30. The skate of claim 1, wherein the nodes of the lattice are disposed in at least five levels that are spaced apart from one another in the given direction from the first layer of the skate to the second layer of the skate.

31. The skate of claim 1, wherein the structural members of the lattice extend in at least five different directions.

32. The skate of claim 1, wherein the structural members of the lattice extend in a multitude of different directions.

33. The skate of claim 1, wherein the structural members of the lattice are created and polymerized separately from one another.

34. The skate of claim 1, wherein the structural members of the lattice comprise struts.

35. A skate comprising a skate boot, wherein the skate boot is configured to enclose a user's foot and comprises:

a first layer and a second layer; and a lattice disposed between and covered by the first layer and the second layer and comprising a predefined arrangement of structural members integral with one another and intersecting one another at nodes;

wherein: at least one of the first layer and the second layer comprises fiber-reinforced polymeric material; and at least one of the first layer and the second layer is heat-formable.

36. A skate comprising a skate boot, wherein the skate boot is configured to enclose a user's foot and comprises:

a first boot material and a second boot material different from the first boot material; and a lattice disposed between and covered by the first boot material and the second boot material and comprising a predefined arrangement of structural members integral with one another and intersecting one another at nodes wherein: at least one of the first boot material and the second boot material is fiber-reinforced; and at least one of the first boot material and the second boot material is heat-formable.

* * * * *